US005678533A

United States Patent [19]

Liljegren

[11] Patent Number: 5,678,533

[45] Date of Patent: Oct. 21, 1997

[54] HOT WATER HEATER WITH SEPARATOR STRUCTURE

[75] Inventor: Leif Liljegren, Oakland, N.J.

[73] Assignee: South Breeze Corporation, Warrenton, Va.

[21] Appl. No.: 642,430

[22] Filed: May 3, 1996

[51] Int. Cl.[6] ..... F24H 1/00

[52] U.S. Cl. ..... 126/361; 126/362; 122/14; 122/17

[58] Field of Search ..... 126/361, 362; 122/13.1, 17, 14

[56] References Cited

U.S. PATENT DOCUMENTS

| | | | |
|---|---|---|---|
| 1,082,168 | 12/1913 | Philp et al. . | |
| 1,519,395 | 12/1924 | Clench . | |
| 1,557,682 | 10/1925 | Gazelle . | |
| 1,885,040 | 10/1932 | Arnold | 122/17 |
| 2,814,278 | 11/1957 | Cameron | 122/17 |
| 4,521,674 | 6/1985 | Scanlan et al. . | |

*Primary Examiner*—Carroll B. Dority
*Attorney, Agent, or Firm*—Brumbaugh, Graves, Donohue & Raymond

[57] ABSTRACT

A hot water heater comprises a tank having top and bottom walls and a peripheral wall having an axis, the tank being adapted to contain water at a predetermined pressure above atmospheric pressure. A separator structure is received in the tank between the axis and the peripheral wall and is configured to separate the tank into an inner chamber surrounding the axis, an outer chamber adjacent the perimeter wall, an intermediate chamber between the inner and outer chambers, and a top chamber adjacent the top wall and above the intermediate chamber. The chambers are in communication for flow of water along a supply path from the outer chamber, through the top chamber, through the inner chamber and into the intermediate chamber, and a reverse flow path opposite to the supply path. The intermediate chamber has an upper closed portion for trapping a volume of gas above a level of water in the tank. A heat source is provided for heating the water in the inner chamber. An inlet conduit leads from outside the tank into the outer chamber, and an outlet conduit leads from the intermediate chamber to outside the tank. Heating and cooling of the trapped gas in the intermediate chamber displaces water from the tank into the supply line when the heat source is supplying heat to heat the water and allows cool water to enter the outer, top and inner chambers after the heat source is turned off.

5 Claims, 2 Drawing Sheets

HOT WATER HEATER WITH SEPARATOR STRUCTURE

BACKGROUND OF THE INVENTION

Hot water heaters that are heated by a fossil fuel (e.g., natural gas, propane gas and oil) have a heating pipe that passes through the water storage tank and conducts hot combustion gases from the fuel burner to a vent pipe. As the hot gases pass through the heating pipe, which usually has baffles, fins and other elements to enhance heat exchange from the gases to the pipe and from the pipe to the water, heat is transferred to the water to heat it. Some of the heat content of the gas flowing through the heating pipe is lost to the vent pipe. When the burner is off, most hot water heaters are still vented to carry off the gases of a pilot burner, and loss of heat by transfer from the water in the tank through the heating pipe to the flow of gases through the heating pipe to the vent pipe exceeds all other standby heat losses. The combination of losses when the burner is on and standby losses (burner off) through the outer walls of the storage tank and through the heating pipe to the vent result in a relative low efficiency for all fossil-fueled hot water heaters.

SUMMARY OF THE INVENTION

An object of the present invention is to provide a hot water heater in which heat losses, particularly standby losses, are significantly reduced, as compared with previously known fossil-fueled hot water heaters. A further object is to enable the improved efficiency to be obtained without unduly increasing the cost of manufacturing the hot water heater. Still another object is to provide a tank configuration for a hot water heater that can be used to advantage with an electrical heat source, such as an immersed electric heating element.

The foregoing objects are attained, in accordance with the present invention, by a hot water heater comprising a tank having top and bottom walls and a peripheral wall having an axis, the tank being adapted to contain water at a predetermined pressure above atmospheric pressure. A separator structure is received in the tank between the axis and the peripheral wall and is configured to separate the tank into an inner chamber surrounding the axis, an outer chamber adjacent the perimeter wall, an intermediate chamber between the inner and outer chambers, and a top chamber adjacent the top wall and above the intermediate chamber. The chambers are in communication for flow of water along a supply path from the outer chamber, through the top chamber, through the inner chamber and into the intermediate chamber, and a reverse flow path opposite to the supply path. The intermediate chamber has an upper closed portion for trapping a mass of gas above a level of water in the tank. A heat source is provided for heating the water in the inner chamber. An inlet conduit leads from outside the tank into the outer chamber, and an outlet conduit leads from the intermediate chamber to outside the tank.

When hot water is drawn from the tank through the outlet conduit, cold water from a supply is conducted into the tank through the inlet conduit. The cold water flows through the supply path, that is, through the outer chamber, the top chamber and the intermediate chamber, and finally enters the intermediate chamber, which is the main storage reservoir for holding hot water in the tank. Soon after the cold supply water begins to flow though the inner chamber, the burner or other heat source for the tank is turned on. The supply water receives some heat from the intermediate chamber and top chamber as it flows toward the inner chamber. The supply water is further heated by heat transfer from the heat source as it flows through the inner chamber. Inasmuch as the water flowing past the heat source in the inner chamber is relatively cool, heat is transferred efficiently from the heat source to the water, thereby extracting more heat from the heat source and reducing losses to the vent pipe in the case of a fossil-fueled unit.

When the outflow of water from the tank ceases, the heat source will remain on and supply heat for a period of time and restore the tank to a full demand heat level. The water in the inner chamber heats rapidly to a very high temperature and produces a reverse flow in the flow path formed by the separator structure. In particular, gases (air and water vapor) trapped in the top of the intermediate chamber become highly heated, thereby causing the trapped gas to expand in volume. Inasmuch as the tank remains open to the supply through the supply conduit (but is closed to the delivery), the expanding gas displaces water from the tank into the supply line. As the very hot water from the inner chamber flows through the top and outer chambers, it gives up some of its heat to the gas and water in the intermediate chamber and some to the peripheral wall of the tank. Water that is displaced from the tank into the supply line also gives up heat by losses from the supply line.

When the heat source shuts off, the heated gases in the top of the intermediate chamber cool relatively rapidly. The gas volume is reduced correspondingly, thus allowing relatively cool water from the supply to flow into the tank along the supply path. By designing the tank so that the displacement volume of the gas trapped in the top of the intermediate chamber exceeds the combined volumes of the outer chamber, top chamber, and inner chamber, all of the water in the outer chamber, top chamber of inner chamber is replaced by relatively cool water from the supply. In that way, the intermediate chamber is isolated by layers of cool water contained in the inner, top and outer chambers. The cool water in the outer chamber reduces heat loss from the water in the intermediate chamber through the perimeter wall of the tank; the cool water in the upper chamber reduces heat loss from the water in the intermediate chamber through the top wall of the tank; and the cool water in the inner chamber reduces heat loss from the water in the intermediate chamber through the heating pipe in the case of fossil-fueled hot water heaters. Accordingly, the main sources of standby losses are reduced significantly, especially losses to a vented heating pipe running through the inner chamber.

In most embodiments of the invention, the separator structure includes an inner wall member defining an outer wall of the inner chamber and an inner wall of the intermediate chamber and an outer wall member defining an outer wall of the intermediate chamber and an inner wall of the outer chamber. The peripheral wall of the tank and the inner and outer wall members of the separator structure are circular cylindrical and concentric with the axis. The inlet conduit, most preferably, leads into the outer chamber proximate the bottom wall of the tank. As mentioned above, the benefits of the invention are especially significant when the heating means includes a fossil fuel burner and a heating pipe passing through the inner chamber of the tank for conducting combustion gases through the inner chamber.

It is also advantageous, according to the present invention, for the separator structure to further separate the tank such as to provide a bottom chamber adjacent the bottom wall and below the intermediate chamber. When included, the bottom chamber communicates solely with the outer chamber. It serves the dual purposes of distributing the water peripherally around the lower end of the outer chamber and providing a layer of relatively cool water for further isolation of the water in the intermediate chamber.

For a better understanding of the invention, reference may be made to the following description of an exemplary embodiment, taken in conjunction with the accompanying drawings.

DESCRIPTION OF THE EMBODIMENT

Figure 1:
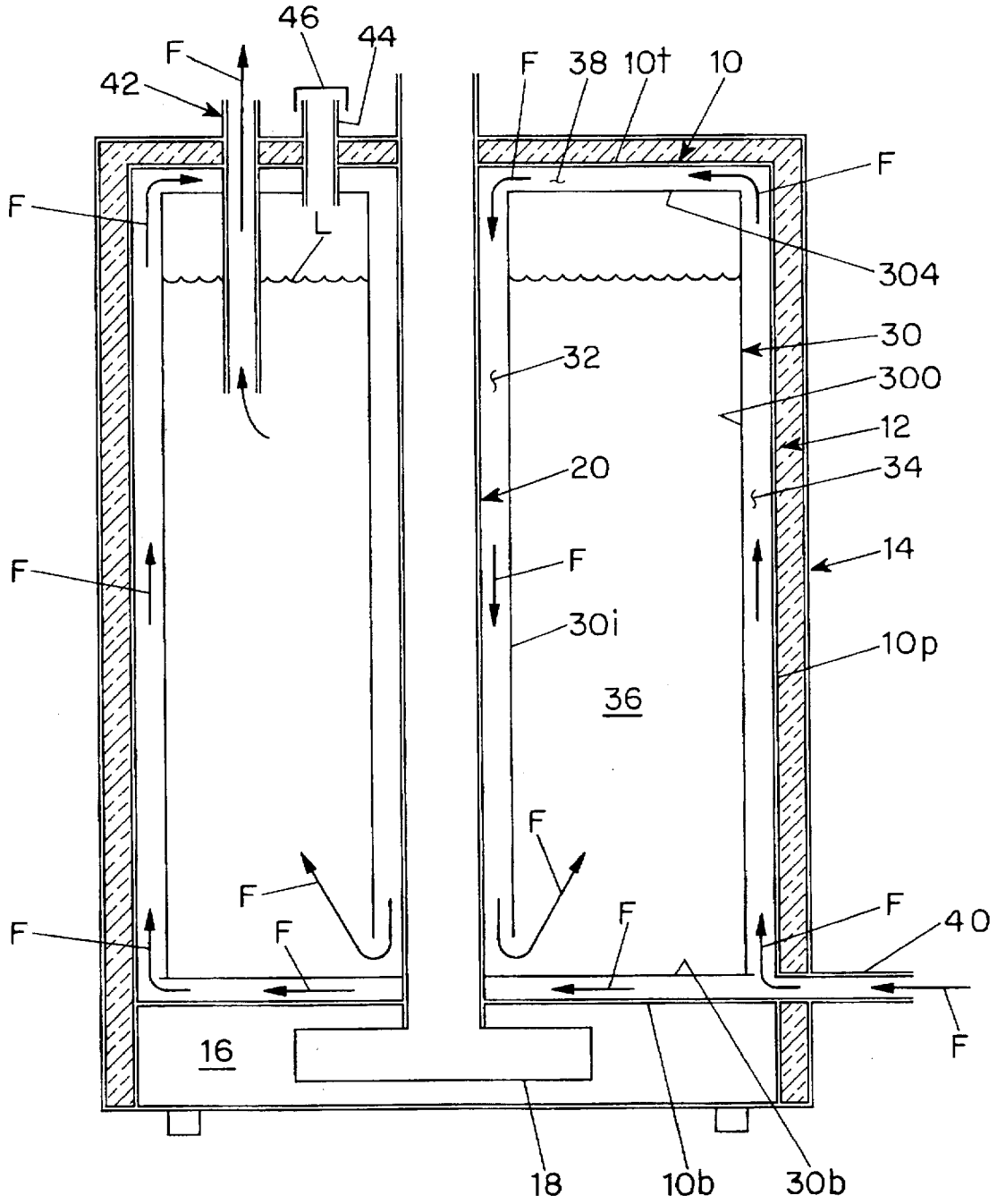
FIG. 1 is a schematic side cross-sectional view of the embodiment taken along the center axis and shows the condition of operation at the point when water is first drawn from the tank after a standby period.

The embodiment includes a tank 10 that is capable of containing water under a supply pressure substantially above atmospheric pressure and has a top wall 10*t*, a bottom wall 10*b*, and a circular cylindrical peripheral wall 10*p*. In practice, it is desirable for the top and bottom walls to be segments of spheres, for greater structural efficiency. The tank 10 is enclosed within a layer 12 of insulation and an outer casing 14. A burner compartment 16 below the tank contains a fossil fuel burner 18 that delivers hot gases to a heating pipe 20 that extends vertically through the center of the tank and leads to a vent pipe (not shown). The heating pipe may include baffles, fins and other elements (not shown) for enhancing the transfer of heat from the combustion gases to the heating pipe and from the heating pipe to the water in the tank.

A separator structure 30 is received in the tank between the heating pipe 20 and the peripheral wall and is configured to separate the tank into an inner chamber 32 surrounding the heating pipe, an outer chamber 34 adjacent the perimeter wall 10*p*, an intermediate chamber 36 between the inner and outer chambers, and a top chamber 38 adjacent the top wall 10*t* and above the intermediate chamber. The chambers are in communication for flow of water along a supply path—indicated by the arrowed lines F in FIG. 1—from the outer chamber 34, through the top chamber 38, through the inner chamber 32 and into the intermediate chamber 36, and a reverse flow path—arrowed lines RF in FIG. 2—opposite to the supply path. The intermediate chamber has an upper closed portion for trapping a mass of gas above a level of water in the tank.

Structurally in the embodiment, the separator structure 30 includes an inner circular cylindrical wall member 30*i*, an outer circular cylindrical wall member 30*o*, an upper annular wall member 30*u* that is joined in gas tight relation to the upper ends of the inner and outer wall members, and a bottom wall member 30*b* that is joined in water tight relation to the heating pipe 20. Inasmuch as the separator structure does not have to sustain any pressure differential, it may be made of thin sheet metal. The bottom wall member 30*b* provides, as described below, an open flow path for distribution of water entering the tank uniformly to the outer chamber 34 and also provides a layer of water below and separated from the water in the intermediate chamber 36, which is the main storage region of the tank. The bottom wall member 30*b*, though preferred, is optional, inasmuch as the water can be distributed peripherally in other ways. When the bottom wall member is omitted, the outer wall member 30*o* rests on the bottom wall 10*b* of the tank in water-tight relation. It is also possible for the bottom wall member 30*b* of the separator structure to have a dependent flange spaced apart from the heating pipe and resting in water-tight relation on the bottom wall 10*b* of the tank and thus supporting the separator structure in the tank. The outer wall member 30*o* may have several leg portions (not shown) extending to the bottom of the tank and resting on the bottom wall, but leaving most of the annular region below the lower edge open for water flow. Similarly, for structural integrity, the inner wall member 30*i* may have leg portions resting on the bottom wall member 30*b*, but also leaving most of the area below the lower edge open. Instead of having terminal edges forming flow passages, holes can be provided in the members of the separator structure 30.

Cold water from a supply source is conducted into the tank through a cold water supply conduit 40, which enters the tank at the bottom of the outer chamber 34. Hot water is drawn from the tank through a hot water outlet conduit 42, which leads from within the intermediate chamber 36 through the top wall 10.

When the tank is initially filled upon installation or after service, it is not completely filled but is filled to so that air is trapped in the top of the intermediate chamber. The volume of the air "bubble" in the top of the intermediate chamber is determined on the basis of the "displacement" of water that occurs when hot water is drawn from the tank and the water in the tank is thereafter reheated to the demand heat capacity in the manner described below. Filling of the tank must, therefore, be carried out with due regard for the temperature of the air trapped in the tank at the time of filling. Suitable means for monitoring the temperature of the trapped gas bubble and the level of water (indicated as "L" in the drawings) in the intermediate chamber when the tank is filled are required. Inasmuch as an air vent pipe 44 from the intermediate chamber is needed and provided, the installer may insert a thermometer and a level measuring device into the tank through the vent pipe and, using a calibration chart for the unit, fill it to the proper level. After filling the tank, a cap 46 is installed on the vent pipe 44.

Figure 2:
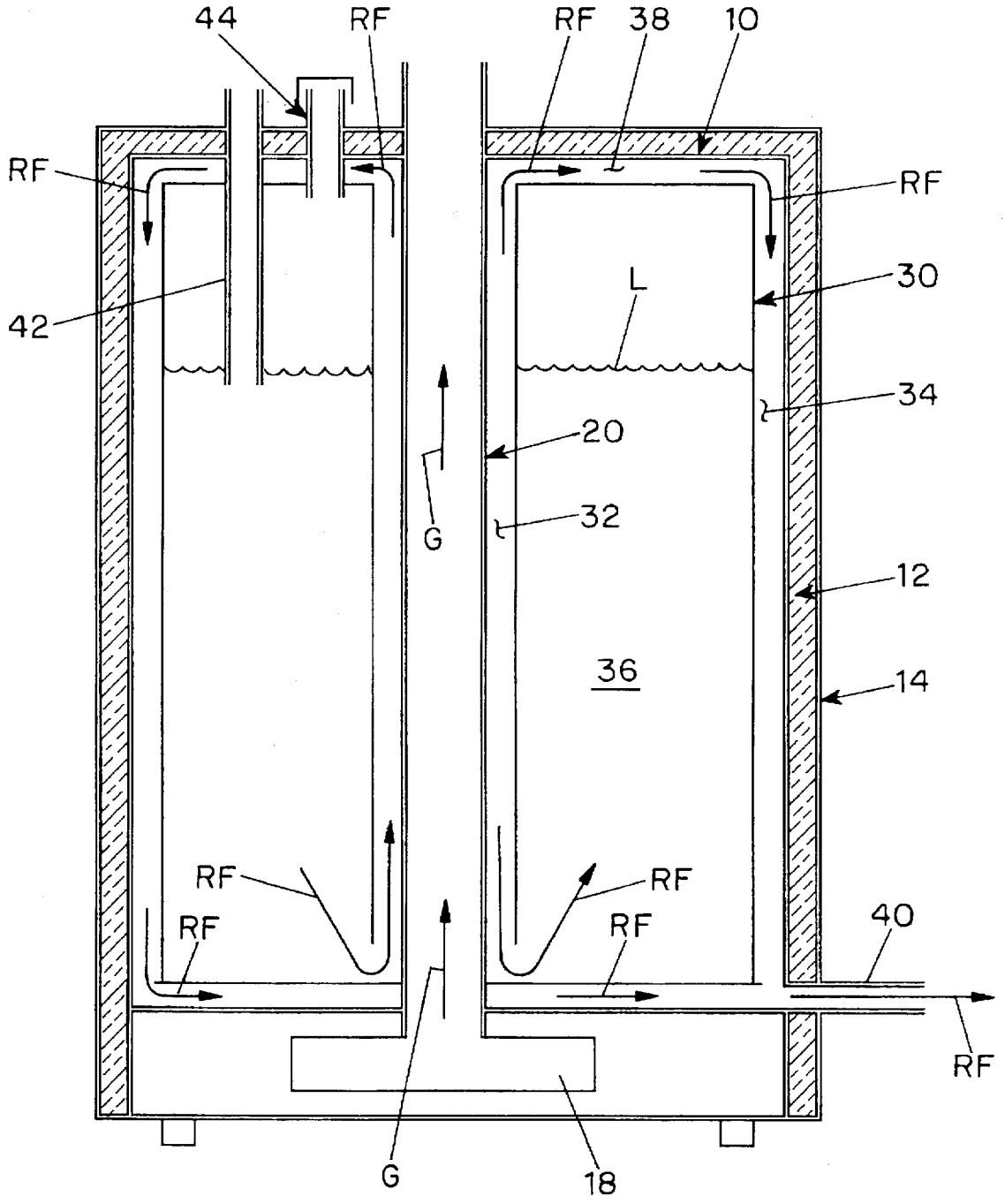
FIG. 2 is a schematic side cross-sectional view of the embodiment that is the same as FIG. 1 but shows the condition of operation at the point when the heat is about to turn off after having restored the tank to full heat demand capacity.

FIG. 1 shows the condition of the tank when it is on standby. When a faucet is opened and hot water is drawn from the tank through the outlet conduit, cold water enters the tank and is distributed reasonably uniformly peripherally to the lower end of the outer chamber 34 by flowing under the bottom wall member 30*b* of the separator structure. The entering cold water flows upwardly through the outer chamber 34, radially inwardly through the top chamber 38, downwardly through the inner chamber 32, and through the lower orifice(s) at the bottom of the inner wall member 30*i* into the intermediate chamber 36. At a suitable time after cold water starts to flow into the tank, the burner 18, under the control of a thermostatic control system of the water heater, is ignited. The combustion gases G flowing up the heating pipe rapidly and efficiently heat the incoming cold water flowing through the inner chamber 32. As mentioned above, the large temperature difference between the cold water flowing downwardly along the heating pipe through the chamber 32 and the combustion gases is conducive to a high rate of heat exchange.

As the entering cold water flows along the surfaces of the upper portion of the separator structure 30, heat is transferred from the upper part of the separator structure and from the gas bubble trapped in the top of the intermediate chamber 36. As the gas bubble cools, it decreases in volume, thus raising the level L of the water in the intermediate chamber. When hot water ceases to be drawn from the tank, the burner continues to burn to restore the tank to the demand heat capacity. As heating of the water in the tank continues, the gas bubble is heated and expands in volume, thereby displacing an equal volume of water from the tank along the reverse flow path RF (FIG. 2) and into the supply conduit 40 and supply line. The water flowing along the flow path, because it is highly heated from passing through the inner chamber 32 and along the heating pipe 20, gives up some heat to the gas bubble and the water in the intermediate chamber. The hot outflowing water also gives up heat to the peripheral wall of the tank. Additional heat is given up from the water displaced from the tank in the cold water supply piping.

After the burner shuts off, heat exchanges within the tank and from the tank to the outside through the tank walls—most significantly, from the heating pipe to the vent relatively quickly lower the temperature of the gas bubble in the top of the tank. The cooling of the gas bubble causes it to contract, thereby allowing cold water to enter from the supply and flow along the supply flow path F. The incoming water from the supply pushes the hot water along the flow path into the intermediate chamber. The incoming cool water also forms layers around the intermediate chamber, i.e., in the outer chamber 34, upper chamber 38 and inner chamber 32. When the water heater is on standby, the layers formed in the inner chamber, top chamber, and outer chamber isolate the intermediate chamber, which is the main storage section of the tank, from heat loss to the environment, and especially from the heating pipe to the vent.

It is apparent from the foregoing description that the tank should be designed so that the volume of water displaced from the tank by the air bubble between the stable condition of FIG. 1 and the end of a heating cycle (FIG. 2.) should exceed the total of the volumes of the outer chamber 34, the top chamber 38 and the inner chamber 32 so that relatively cool water is drawn from the supply into the inner chamber, thereby to minimize heat losses to the heating pipe and vent.

I claim:

1. A hot water heater comprising a tank having top and bottom walls and a peripheral wall having an axis, the tank being adapted to contain water at a predetermined pressure above atmospheric pressure, a separator structure received in the tank between the axis and the peripheral wall and separating the tank into an inner chamber surrounding the axis, an outer chamber adjacent the perimeter wall, an intermediate chamber between the inner and outer chambers, and a top chamber adjacent the top wall and above the intermediate chamber, the chambers being in communication for flow of water along a supply path from the outer chamber, through the top chamber, through the inner chamber and into the intermediate chamber and the intermediate chamber having an upper closed portion for trapping a mass of gas above a level of water in the tank, means for heating the water in the inner chamber, an inlet conduit leading from outside the tank into the outer chamber, and an outlet conduit leading from the intermediate chamber to outside the tank.

2. A hot water heater according to claim 1 wherein the separator structure includes an inner wall member defining an outer wall of the inner chamber and an inner wall of the intermediate chamber and an outer wall member defining an outer wall of the intermediate chamber and an inner wall of the outer chamber, and wherein the peripheral wall of the tank and the inner and outer wall members of the separator structure are circular cylindrical and concentric with the axis.

3. A hot water heater according to claim 1 wherein the inlet conduit leads into the outer chamber proximate the bottom wall of the tank.

4. A hot water heater according to claim 1 wherein the heating means includes a fossil fuel burner and a heating pipe passing through the inner chamber of the tank for conducting combustion gases through the inner chamber.

5. A hot water heater according to claim 1 wherein the separator structure further separates the tank into a bottom chamber adjacent the bottom wall and below the intermediate chamber and wherein the bottom chamber communicates solely with the outer chamber.

* * * * *